US009074771B2

(12) United States Patent
Böttcher et al.

(10) Patent No.: US 9,074,771 B2
(45) Date of Patent: Jul. 7, 2015

(54) BURNER INSERTS FOR A GAS TURBINE COMBUSTION CHAMBER AND GAS TURBINE

(75) Inventors: Andreas Böttcher, Mettmann (DE); Andre Kluge, Dülmen (DE); Tobias Krieger, Duisburg (DE); Jürgen Meisl, Mülheim an der Ruhr (DE); Kai-Uwe Schildmacher, Mülheim a.d. Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 885 days.

(21) Appl. No.: 13/126,239

(22) PCT Filed: Sep. 14, 2009

(86) PCT No.: PCT/EP2009/061854

§ 371 (c)(1),
(2), (4) Date: Apr. 27, 2011

(87) PCT Pub. No.: WO2010/049206

PCT Pub. Date: May 6, 2010

(65) Prior Publication Data

US 2011/0197590 A1 Aug. 18, 2011

(30) Foreign Application Priority Data

Oct. 29, 2008 (EP) ..... 08018907

(51) Int. Cl.
*F23R 3/00* (2006.01)
*F23R 3/10* (2006.01)

(52) U.S. Cl.
CPC . *F23R 3/002* (2013.01); *F23R 3/10* (2013.01); *F23R 2900/03042* (2013.01)

(58) Field of Classification Search
CPC .. F23R 3/002; F23R 2900/00014; F23R 3/16; F23R 3/50
USPC ..... 60/752, 755, 756
See application file for complete search history.

(56) References Cited

U.S. PATENT DOCUMENTS

| | | | | |
|---|---|---|---|---|
| 4,914,918 | A * | 4/1990 | Sullivan | 60/756 |
| 5,396,759 | A | 3/1995 | Richardson | |
| 5,419,115 | A * | 5/1995 | Butler et al. | 60/756 |
| 5,974,805 | A | 11/1999 | Allen | |
| 6,032,457 | A * | 3/2000 | McKinney et al. | 60/756 |
| 6,164,074 | A | 12/2000 | Madden et al. | |
| 6,792,757 | B2 * | 9/2004 | Borns et al. | 60/752 |
| 2004/0083735 | A1 | 5/2004 | Borns et al. | |

(Continued)

FOREIGN PATENT DOCUMENTS

| | | | |
|---|---|---|---|
| EP | 1557607 | A1 | 7/2005 |
| EP | 1767855 | A1 | 3/2007 |
| GB | 2 107448 | A | 4/1983 |

(Continued)

*Primary Examiner* — Ted Kim

(57) ABSTRACT

A burner insert for a gas turbine combustion chamber is provided. The burner insert includes a burner insert wall including a cold side and a hot side, an edge delimiting the burner insert wall. The edge includes an edge bar extending at least partially circumferentially and projecting beyond the cold side. A burner opening for inserting a burner is formed in the burner insert wall.

14 Claims, 7 Drawing Sheets

(56) References Cited

U.S. PATENT DOCUMENTS

| | | | | |
|---|---|---|---|---|
| 2005/0138931 | A1 | 6/2005 | Pacheco-Tougas et al. | |
| 2008/0314044 | A1 * | 12/2008 | Bronson et al. | 60/754 |

FOREIGN PATENT DOCUMENTS

| | | | |
|---|---|---|---|
| RU | 31818 | U1 | 8/2003 |
| RU | 52992 | U1 | 4/2006 |

* cited by examiner

BURNER INSERTS FOR A GAS TURBINE COMBUSTION CHAMBER AND GAS TURBINE

CROSS REFERENCE TO RELATED APPLICATIONS

This application is the US National Stage of International Application No. PCT/EP2009/061854, filed Sep. 14, 2009 and claims the benefit thereof. The International Application claims the benefits of European Patent Office application No. 08018907.9 EP filed Oct. 29, 2008. All of the applications are incorporated by reference herein in their entirety.

FIELD OF INVENTION

The present invention relates to a burner insert for a gas turbine combustion chamber, which comprises a burner opening for inserting a burner. The invention also relates to a gas turbine.

BACKGROUND OF INVENTION

Gas turbine combustion chambers comprise a burner-side end and a turbine-side end. The turbine-side end is open and enables the hot combustion gases produced in the combustion chamber to flow out to the turbine. At the burner-side end a burner insert is often present which comprises a heat-resistant hot side and a cooled cold side. The burner is inserted into an opening in the burner insert. When the gas turbine is operating, cold air which as a rule comes from the compressor flows along the cold side from the burner opening of the burner insert to its outer edge, from where the cold air flows into the combustion chamber. An example of a burner insert in a can-type combustion chamber is described in US 2005/0016178 A1.

In the case of annular combustion chambers, in other words combustion chambers which extend in annular fashion around the turbine rotor, as a rule a plurality of burner inserts is arranged side by side in the circumferential direction of the annular combustion chamber. The cold air flowing past the cold side of the burner side then flows between the radially outer wall and the radially inner wall of the combustion chamber into the combustion chamber. In addition, cold air can also be introduced into the combustion chamber through gaps between adjacent burner inserts in the circumferential direction. Such an annular combustion chamber is described for example in EP 1 557 607 A1. Alternatively, it is also possible to direct the cold air towards the burner opening instead of away from the burner opening of the burner insert and then to introduce said cold air into the combustion chamber through an annular gap between the edge of the burner opening and the inserted burner, as is described in EP 1 767 855 A1.

A burner insert for an annular combustion chamber is illustrated schematically in FIG. 1. The figure shows a sectional perspective view of the cold side 103 of a burner insert for an annular combustion chamber. In the center of the cold side 103 of the burner insert 100 is situated an opening 105, into which the burner can be inserted. The burner insert is secured by means of an annular bar 107 in the section 109 of the burner insert 100 projecting beyond the cold side on a support structure in the gas turbine housing.

During operation of the gas turbine combustion chamber, pressure fluctuations may occur therein which can excite the burner insert to high-frequency oscillations. These stress the burner insert and shorten its useful life. In order to stiffen the burner insert and to direct the cold air, the cold side 103 of the burner insert 100 is provided with ribs 111. Furthermore, support bolts 113 are present, which are indicated only schematically in FIG. 1. The bolts 113 and the ribs 111 constitute contact sections by means of which the cold side comes into contact with the support structure in the gas turbine housing. With regard to such types of burner inserts, the formation of an uneven gap can occur along the circumferential edge of the burner insert, which can lead to an excess supply of cold air at points having an enlarged gap. Furthermore, on account of the fact that the support bolts 113 are also present in addition to the ribs 111, a static overdeterminacy results because the burner insert 100 should simultaneously bear both on the ribs 11 and also on the bolts.

SUMMARY OF INVENTION

Compared with this prior art, the object of the present invention is to make available an advantageous burner insert for a gas turbine combustion chamber. A further object is to make available an advantageous gas turbine combustion chamber and an advantageous gas turbine.

The first object is achieved by a burner insert as claimed in the claims, the second object by a gas turbine combustion chamber as claimed in the claims and a gas turbine as claimed in the claims respectively. The dependent claims contain advantageous embodiments of the invention.

A burner insert according to the invention for a gas turbine combustion chamber has a burner insert wall having a cold side and a hot side. A burner opening for inserting a burner is formed in the burner insert wall. The burner insert has an outer edge delimiting the burner insert wall, with an at least partially circumferential edge strip projecting beyond the cold side. In this situation, the edge can be formed to be largely circular, for instance in the case of a can-type combustion chamber, or, for example in the case of an annular combustion chamber, can have the form of the edge of an annular segment. Other contours are also possible in principle, depending on the form of the combustion chamber.

The edge strip of the burner insert according to the invention results in an increase in the resonance frequencies compared with a burner insert according to the prior art as has been described with reference to FIG. 1. The vibration stress on the burner insert during operation of the combustion chamber is therefore reduced in comparison with the burner insert from the prior art. Furthermore, during operation of the gas turbine combustion chamber the edge strip can bear completely on the support structure in the gas turbine housing, such that a uniform gap, preferably a zero gap, is present along the entire edge. In order to not interrupt the cold air flow in the presence of a zero gap, in a development of the invention the edge strip is provided with openings for the passage of cooling fluid. In order to implement the openings, the edge strip can have castellations, between which the openings are formed, and/or can be equipped with through-holes, drilled holes for example. As a result of the fact that defined openings can be produced in the edge strip by means of the castellations, or the holes, it is possible to exactly set the cold air quantity passing through the edge strip by suitable choice of the castellation size or of the free diameter of the holes. In the case of castellations, these can be produced for instance by interrupting the edge strip. It is however advantageous if the edge strip is not interrupted and instead the edge strip projects further beyond the cold side in the castellation regions than in the remaining regions of the edge strip. In addition to the openings described, further forms of openings are also conceivable, slots for example.

By preference, the edge strip runs around the entire edge of the burner insert. The stiffness of the edge of the burner insert is then particularly high.

In a special embodiment of the burner insert according to the invention, the burner opening is surrounded by an annular wall region projecting beyond the cold side and provided with an annular bar. Otherwise, the burner insert wall is flat in form, in other words no further structures exist, such as for instance the ribs present in the prior art. In the case of the burner insert according to the invention, such types of ribs are superfluous because it has become clear that a uniform distribution of the cold air also takes place without such ribs. A stiffening function of the ribs is also not required in the burner insert according to the invention.

Overall, the burner insert according to the invention enables savings to be achieved in terms of cold air usage because no non-uniform gap dimensions occur which may result in a surplus in the cold air supply. The reduced cold air feed into the combustion chamber consequently results in a reduction in harmful emissions from the gas turbine and to higher turbine inlet temperatures, which in turn enables an increase in the efficiency of the gas turbine. In the case of openings in the edge gap, for example in the form of castellations or through-openings, it is moreover possible through suitable choice of the opening cross-sections to set the quantity of cold air flowing into the combustion chamber in a defined manner. Furthermore, it is possible to set a zero gap between the front surface of the edge strip or the castellations and the support structure or the combustion chamber wall. Finally, the design of the burner insert according to the invention also makes possible a reduction in costs because the stiffening bolts are dispensed with and therefore fewer components are required in comparison with the burner insert described in the introduction.

A gas turbine combustion chamber according to the invention comprises at least one burner, at least one combustion chamber wall surrounding a combustion chamber interior and at least one burner-side combustion chamber end wall. It incorporates a burner insert according to the invention, the burner insert wall of which forms the combustion chamber end wall, whereby the hot side of the burner insert wall faces the combustion chamber interior. In the combustion chamber according to the invention the combustion chamber wall can in the case of a can-type combustion chamber be embodied in a cylindrical shape. In the case of an annular combustion chamber, two combustion chamber walls are however present, namely one radially outer and one radially inner combustion chamber wall.

The advantages which can be achieved by using the burner insert according to the invention can thus be implemented in the gas turbine combustion chamber according to the invention.

In the gas turbine combustion chamber according to the invention, between the combustion chamber end wall formed by the at least one burner insert and the at least one combustion chamber wall a gap may be present which enables cold air to flow away from the cold side of the burner insert into the combustion chamber.

In the case of a gas turbine combustion chamber embodied as an annular combustion chamber and having an annular combustion chamber interior formed between an inner combustion chamber wall and an outer combustion chamber wall, the burner-side combustion chamber end wall can in particular be formed by a number of burner inserts arranged side by side in the circumferential direction of the combustion chamber. Gaps may be present between adjacent burner inserts, which enable cold air to flow in between the burner inserts into the annular combustion chamber.

A gas turbine according to the invention is equipped with at least one gas turbine combustion chamber which is embodied as a gas turbine combustion chamber according to the invention. Furthermore, the gas turbine according to the invention incorporates a cooling fluid reservoir, for example a combustion chamber plenum being connected to the output of a compressor, whereby the cold side of the burner insert wall has a flow connection with the cooling fluid reservoir. Such a gas turbine makes it possible to implement the advantages of a combustion chamber having a burner insert according to the invention.

BRIEF DESCRIPTION OF THE DRAWINGS

Further features, attributes and advantages of the present invention will emerge from the description which follows of an exemplary embodiment with reference to the attached figures.

DETAILED DESCRIPTION OF INVENTION

Figure 1:
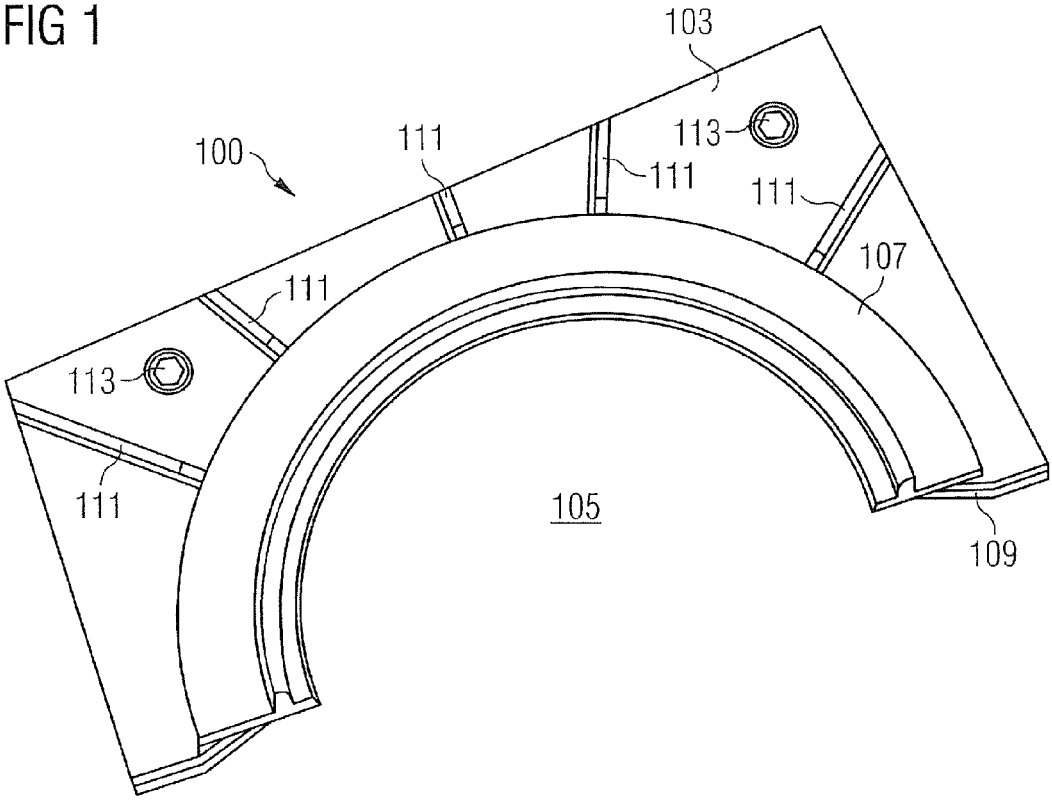
prior art FIG 1
FIG. 1 shows a burner insert according to the prior art.
Figure 2:
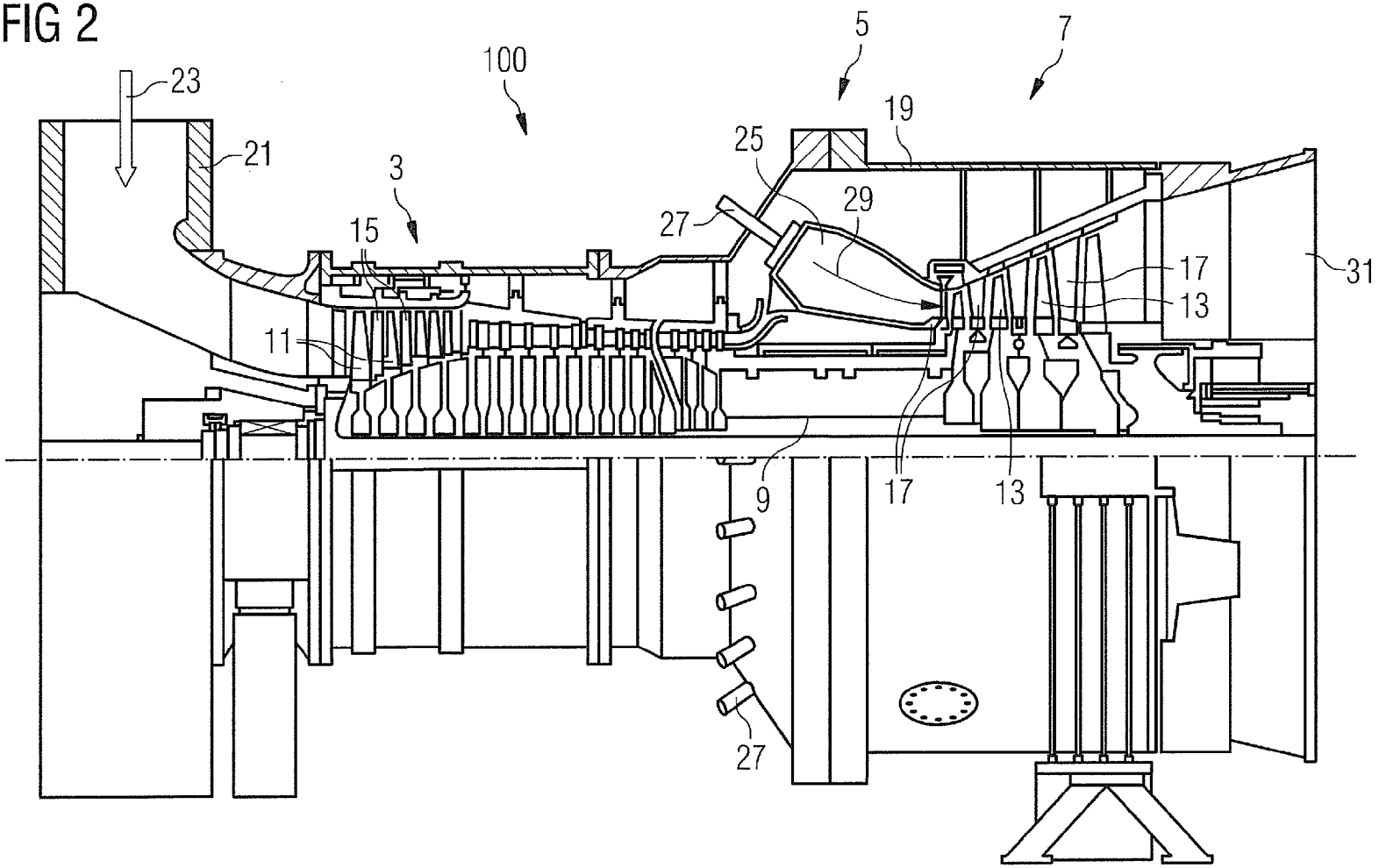
FIG. 2 shows a partial longitudinal section of a gas turbine.

FIG. 2 shows a longitudinal section of a gas turbine 1 which comprises a compressor section 3, a combustion chamber section 5 and a turbine section 7. A shaft 9 extends through all the sections of the gas turbine 1. In the compressor section 3 the shaft 9 is equipped with rings of compressor blades 11 and in the turbine section 7 with rings of turbine blades 13. Rings of compressor guide vanes 15 are situated between the rings of blades in the compressor section 3 and rings of turbine guide vanes 17 are situated between the rings of blades in the turbine section 7. The guide vanes extend from the housing 19 of the gas turbine unit 1 essentially in the radial direction to the shaft 9.

During operation of the gas turbine 1, air 23 is drawn in through an air inlet 21 of the compressor section 3 and compressed by the compressor blades 11. The compressed air is fed to a combustion chamber 25 arranged in the combustion chamber section 5, which in the present exemplary embodiment is embodied as an annular combustion chamber, into which a gaseous or liquid fuel is also injected by way of at least one burner 27. The air/fuel mixture produced thereby is ignited and combusted in the combustion chamber 25. The hot combustion exhaust gases flow along the flow path 29 from the combustion chamber 25 into the turbine section 7 where they expand and cool and in doing so transfer momentum to the turbine blades 13. In this situation, the turbine guide vanes 17 serve as jets for optimizing the transfer of momentum to the blades 13. The rotation of the shaft 9 brought about by the transfer of momentum is used in order to drive a load, for example an electrical generator. The expanded and cooled combustion gases are finally discharged from the turbine 1 through an outlet 31.

Figure 3:
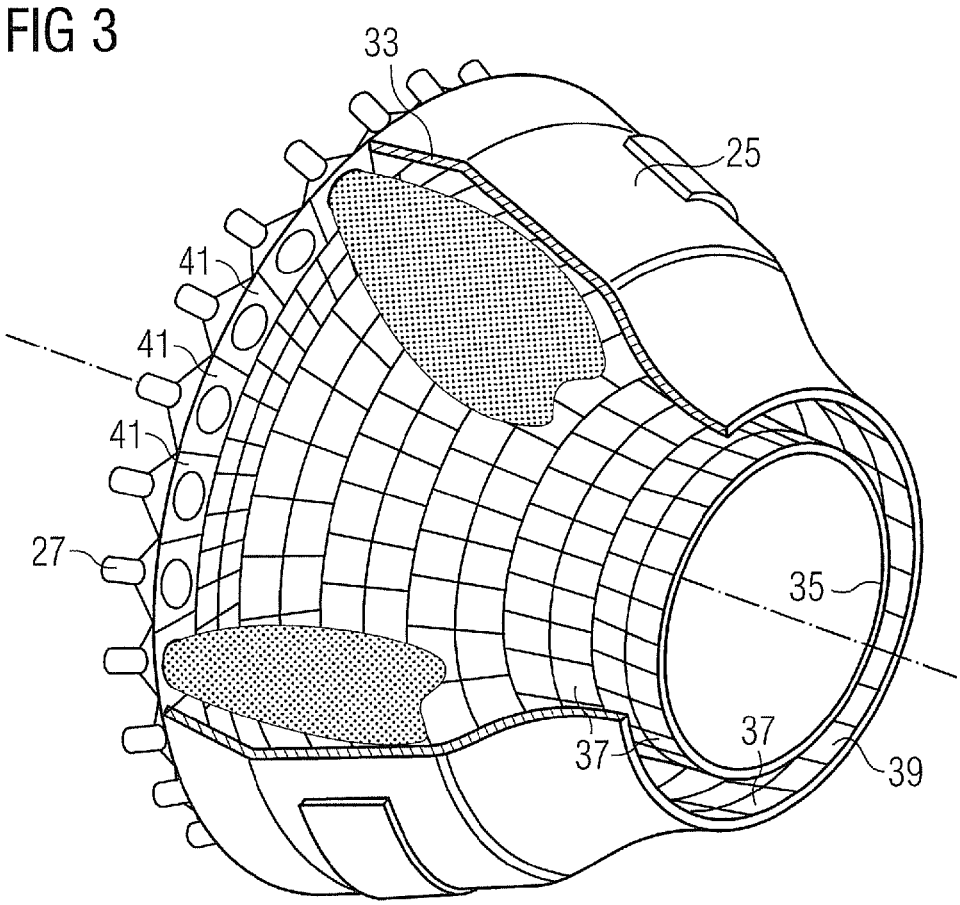
FIG. 3 shows a partial sectional perspective view of an annular combustion chamber.
Figure 8:
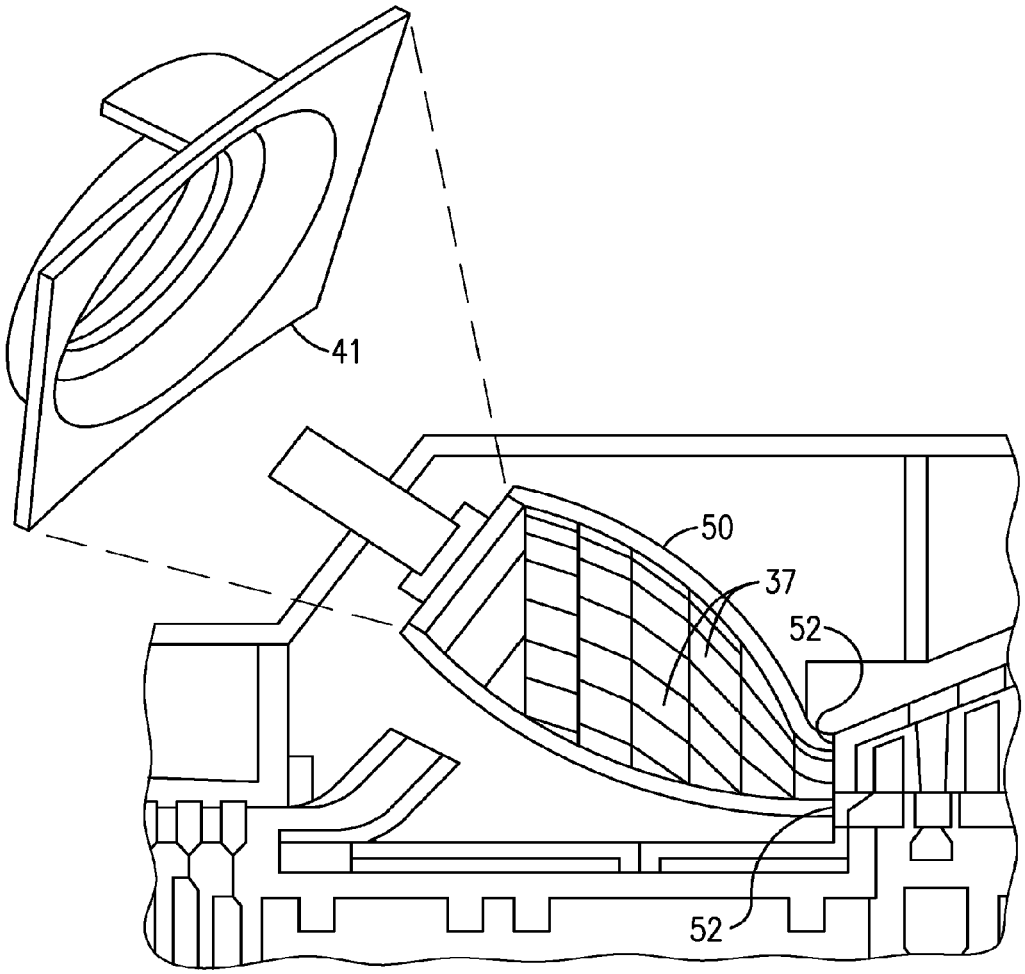
FIG. 8 is a schematic illustrating a burner insert arranged on a support structure which is affixed on a housing of gas turbine.

The annular combustion chamber 25 of the gas turbine represented in FIG. 2 is illustrated in FIG. 3 in a partial sectional perspective view. The outer combustion chamber wall 33 can be seen, and also the inner combustion chamber wall 35. Both the outer combustion chamber wall 33 and also the inner combustion chamber wall 35 are equipped with a hot gas resistant lining which is formed from heat shield elements 37. Ceramic heat shield elements are used as heat shield elements in the present exemplary embodiment. The end of the combustion chamber facing the turbine section 7 has a hot gas outlet opening 39, through which the hot combustion gases produced in the interior of the combustion chamber 25 can flow to the turbine. A combustion chamber end wall formed from burner inserts 41 is present at the end of the annular combustion chamber 25 opposite the hot gas exit 39. A burner 27 is housed in each burner insert 41. In this situation, the burner inserts 41 are not connected directly to the outer combustion chamber wall 33 and the inner combustion chamber wall 35 but are arranged on a support structure 50 (schematically shown in FIG. 8) which is in turn affixed on the housing of the gas turbine, as schematically represented by circles 52. Between the individual burner inserts 41 on the one hand and also the outer wall 33 and the inner wall 35 on the other hand there remains a gap which enables cold air to flow in along the respective wall into the interior of the combustion chamber. Furthermore, the burner inserts 41 are arranged such that gaps also remain between them, in other words between edges of the burner inserts 41 which are adjacent in the circumferential direction, which gaps enable cold air to enter the combustion chamber interior.

Figure 4:
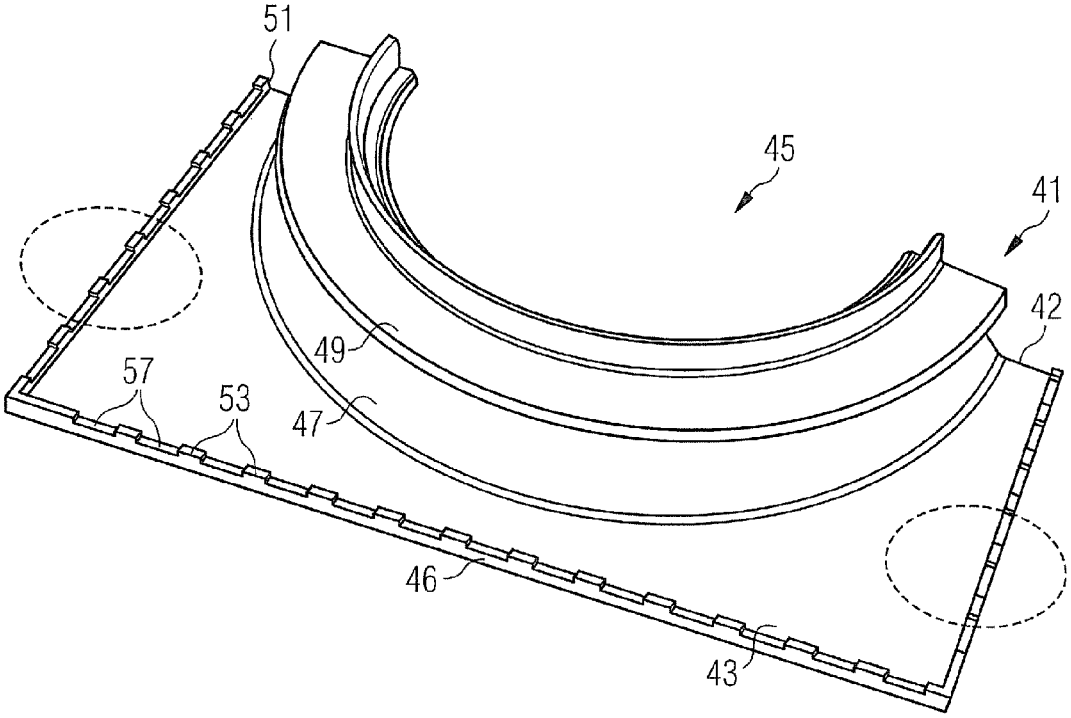
FIG. 4 shows a burner insert according to the invention.

A burner insert is illustrated in a partial sectional perspective view in FIG. 4. It comprises a burner insert wall 42 having a cold side 43 and also a hot side 44 which is to face the combustion chamber interior (the hot side cannot be seen in FIG. 4). The cold side 43 has a flow connection with the output from the compressor which means that compressor air can be directed past the cold side 43 for cooling purposes in order to maintain the temperature of the hot side at an acceptable level for the material of the burner insert 41. The hot side is furthermore provided with a heat-insulating coating, for example in the form of a ceramic coating, in order to reduce the demand for cold air.

At its center the burner insert 41 has an opening 45 into which the outlet from a burner 27 can be inserted. The opening 45 is delimited by a section 47 of the burner insert wall 42 projecting beyond the cold side 43. From this projecting section 47 extends an annular bar 49 running in the radial direction of the opening 45, by means of which the burner insert 41 can be affixed to a retaining structure.

In the present exemplary embodiment, the entire outer edge 46 of the burner insert 41 is provided with an edge strip 51 projecting beyond the cold side 43, which gives the edge 46 an increased stiffness and ensures that the resonance frequency of the burner insert wall 42 is increased. Detail views of the edge 46 with the edge strip 51 are illustrated in FIGS. 5 and 6.

The edge strip 51 has castellations 53 which are formed by sections of the edge strip 51 which project further beyond the cold side 43 than the remaining sections 54 of the edge strip 51. When the burner insert is affixed to a support structure and fauns a part of a combustion chamber end wall, the castellations 53 with their front surfaces 55 furthest away from the cold side 43 rest against a contact surface of the retaining structure with a zero gap. Between the castellations 53 are then faulted windows 57, through which cold air which as a rule is delivered from the compressor in the region of the projecting wall section 47 can flow out into the combustion chamber. The cold air can then flow, providing cooling, along the cold side 43 which is completely flat in form apart from the edge strip 51 and the projecting wall region 47. The windows 57 between the castellations 53 constitute openings having a defined flow-through cross-section for the flowing cold air because the front surfaces 55 of the castellations 53 rest against the contact structure with a zero gap. Through suitable choice of the width and height of the edge strip sections 54 between the castellations 53 in relation to the height and width of the castellations 53 it is possible to specifically set the cold air quantity flowing into the combustion chamber. On account of the increased stiffness which the edge strip 51 gives the edge 46, there are also no significant deviations occurring in the gap between the castellation surfaces 55 and the contact surface, which means that the flow cross-section present for the cold air and defined by the windows is also largely maintained during operation of the gas turbine. Excess supplies of cold air resulting from increasing gap dimensions can be substantially reduced by this means in comparison with the prior art, which in turn leads to a decrease in the cold air entering the combustion chamber and thus ultimately to a lowering of pollutant levels and to higher turbine inlet temperatures.

Figure 5:
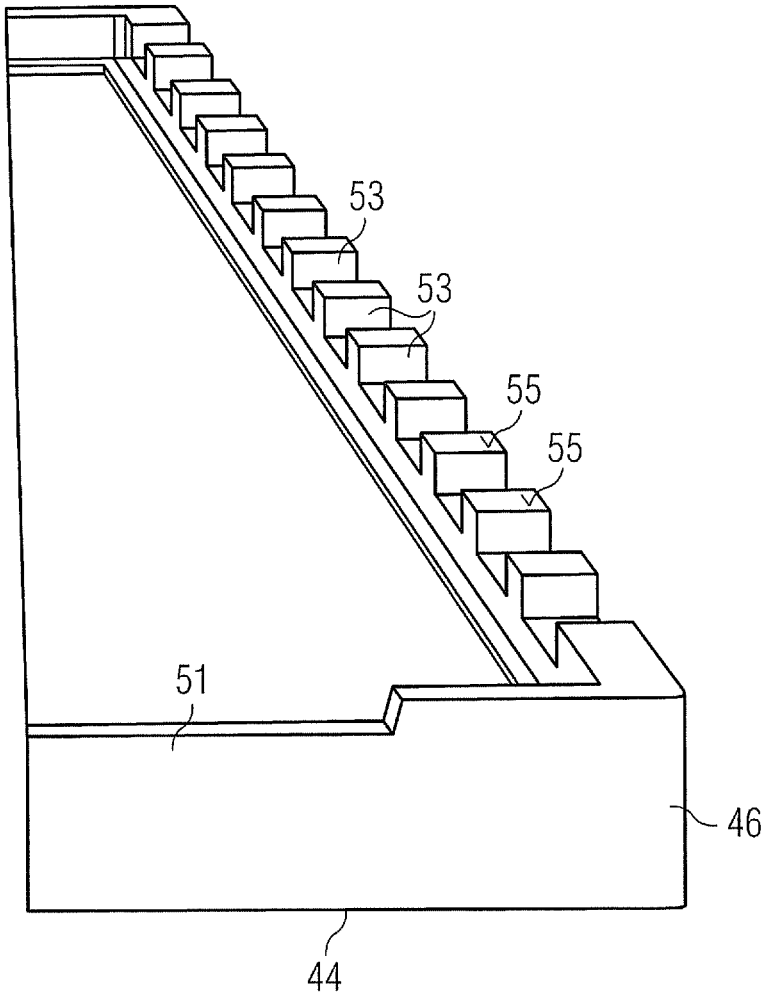
FIG. 5 shows the edge of the burner insert from FIG. 4.
Figure 6:
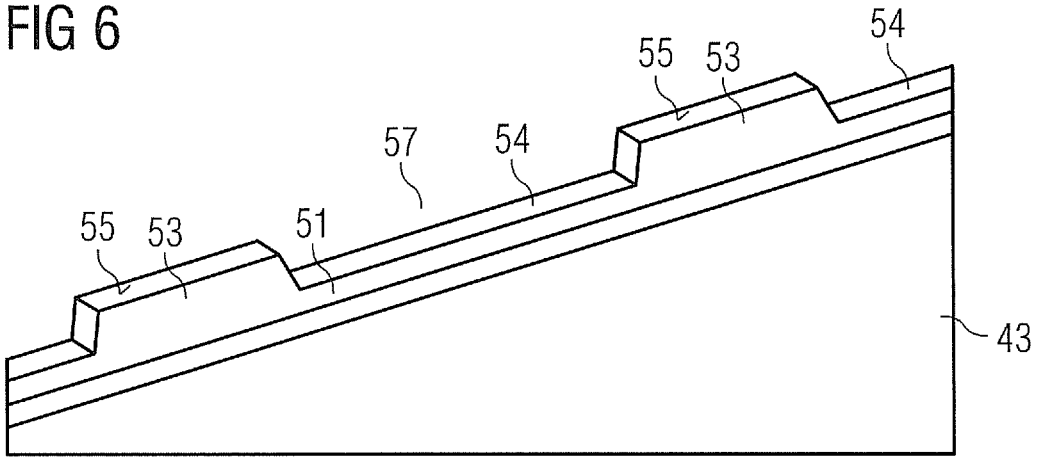
FIG. 6 shows a detail view of the edge of the burner insert.
Figure 7:
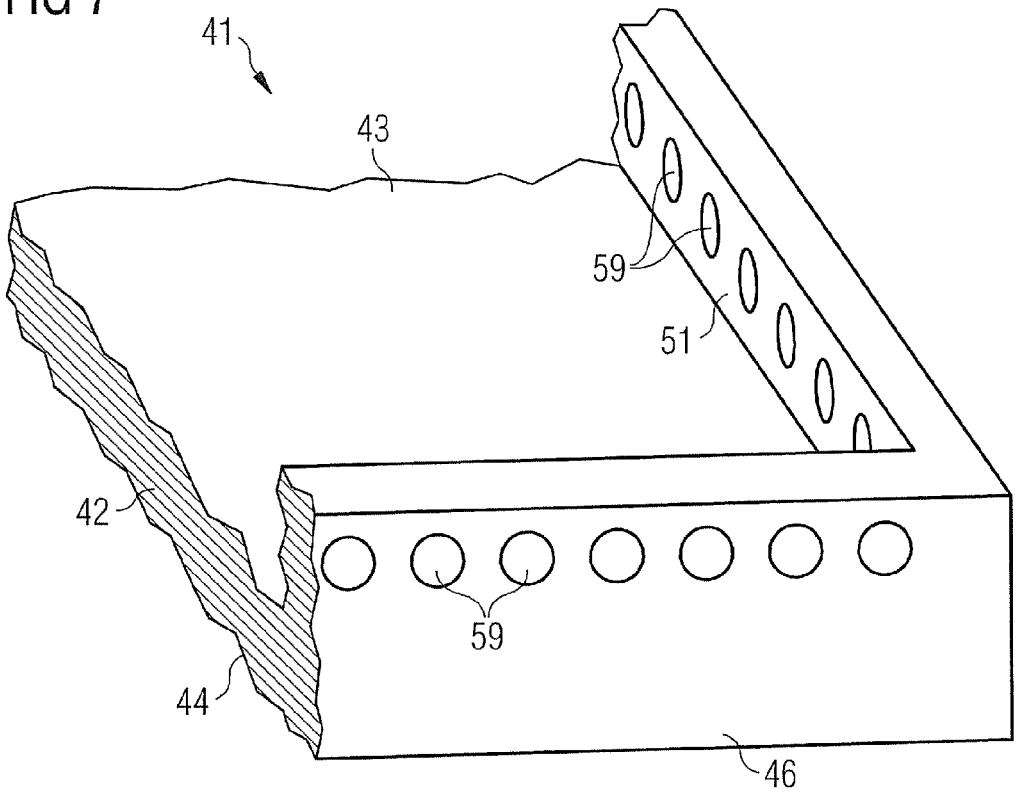
FIG. 7 shows a detail view of the edge of a modified burner insert.

Although the edge strip 51 in the exemplary embodiment shown in FIGS. 4 to 6 is provided with castellations 53 in order to define window openings 57 for the cold air, it is also possible to allow the edge strip 51 to project uniformly beyond the cold side 43. Cooling air passages can then be implemented by means of through-holes 59, in the form of drilled holes for instance. A corresponding exemplary embodiment of the burner insert according to the invention is illustrated in FIG. 7.

Although the edge strip extends along the entire outer edge 46 of the burner insert 41 in the present exemplary embodiments, embodiment variants are conceivable in which regions of the outer edge 46 of the burner insert 41 have no edge strip 51. Furthermore, embodiment variants for cylindrical combustion chambers are possible. In such an embodiment variant, the outer edge of the burner insert would essentially be circular and the edge strip would be present at least along a part of the circumference, preferably around the entire circumference.

The invention enables the resonance frequency of the burner insert to be increased and simultaneously allows the flow of cold air into the combustion chamber to be specifically set in such a manner that the cold air is only able to flow through the predefined gaps. Associated therewith, further advantages of the invention result, such as for example an extended useful life of the burner insert and through the cold air saved at the burner insert—a lowering of pollutant levels whilst offering the same performance of the gas turbine provided with burner inserts according to the invention when the saved cold air is delivered to the burner. Alternatively, an improved performance can be achieved at the same level of emissions.

The invention claimed is:

1. A gas turbine combustion chamber, comprising:

a burner;

a combustion chamber wall surrounding a combustion chamber interior and a combustion chamber end wall; and a burner insert arranged without stiffening bolts on a support structure which is affixed on a housing of gas turbine, comprising:

a burner insert wall including a cold side and a hot side, wherein a burner opening for inserting the burner is formed in the burner insert wall, wherein the burner insert wall includes an edge delimiting the burner insert wall, wherein the edge includes an at least partially circumferential edge strip projecting beyond the cold side and a plurality of openings, each of the openings allowing passage of cooling fluid, wherein the edge strip includes a plurality of castellations and the plurality of openings are formed between respective adjacent castellations of the plurality of castellations, wherein the burner insert wall at least in part forms the combustion chamber end wall, wherein the hot side of the burner insert wall faces the combustion chamber interior, wherein the edge strip runs around an entire edge and is positioned proximate the combustion chamber wall, and wherein the edge strip bears completely on the support structure along the entire edge, wherein stiffness provided by the edge strip is effective to maintain a uniform gap along the entire edge during operation of the gas turbine, the uniform gap effective to reduce the amount of cooling fluid that enters the combustion chamber.

2. The gas turbine combustion chamber as claimed in claim 1, wherein the uniform gap is present between the combustion chamber end wall formed by the burner insert and the combustion chamber wall.

3. The gas turbine combustion chamber as claimed in claim 1, wherein the gas turbine combustion chamber is an annular combustion chamber including an annular combustion chamber interior formed between an inner combustion chamber wall and an outer combustion chamber wall, and wherein the combustion chamber end wall is formed by a plurality of burner inserts arranged side by side in a circumferential direction of the annular combustion chamber.

4. The gas turbine combustion chamber as claimed in claim 3, wherein a plurality of gaps are present between adjacent burner inserts.

5. The gas turbine combustion chamber as claimed in claim 1, wherein the plurality of castellations are formed by a first plurality of edge strip sections which project further beyond the cold side than a plurality of remaining edge strip sections.

6. The gas turbine combustion chamber as claimed in claim 1, wherein the burner opening is surrounded by an annular wall region projecting beyond the cold side and provided with an annular bar.

7. The gas turbine as claimed in claim 1, wherein the uniform gap comprises a zero gap.

8. The gas turbine as claimed in claim 1, wherein the support structure is a portion of the combustion chamber wall.

9. A gas turbine, comprising:

a cooling fluid reservoir; and a gas turbine combustion chamber, comprising:

a burner, a combustion chamber wall surrounding a combustion chamber interior and a combustion chamber end wall, and a burner insert arranged without stiffening bolts on a support structure which is affixed on a housing of gas turbine, comprising:

a burner insert wall including a cold side and a hot side, wherein a burner opening for inserting the burner is formed in the burner insert wall, wherein the burner insert wall includes an edge delimiting the burner insert wall, wherein the edge includes an at least partially circumferential edge strip projecting beyond the cold side and a plurality of openings, each of the openings allowing passage of cooling fluid, wherein the edge strip includes a plurality of castellations and the plurality of openings are formed between respective adjacent castellations of the plurality of castellations, wherein the burner insert wall at least in part forms the combustion chamber end wall, wherein the hot side of the burner insert wall faces the combustion chamber interior, wherein the edge strip runs around an entire edge and is positioned proximate the combustion chamber wall, wherein the edge strip bears completely on the support structure along the entire edge, wherein stiffness provided by the edge strip is effective to maintain a uniform gap along the entire edge during operation of the gas turbine, the uniform gap effective to reduce the amount of cooling fluid that enters the combustion chamber, and wherein the cold side of the burner insert wall includes a flow connection with the cooling fluid reservoir.

10. The gas turbine as claimed in claim 9, wherein the uniform gap is present between the combustion chamber end wall formed by a burner insert and the combustion chamber wall.

11. The gas turbine as claimed in claim 9, wherein the gas turbine combustion chamber is an annular combustion chamber including an annular combustion chamber interior formed between an inner combustion chamber wall and an outer combustion chamber wall, and wherein the combustion chamber end wall is formed by a plurality of burner inserts arranged side by side in a circumferential direction of the annular combustion chamber.

12. The gas turbine as claimed in claim 11, wherein a plurality of gaps are present between adjacent burner inserts.

13. The gas turbine as claimed in claim 9, wherein the uniform gap comprises a zero gap.

14. The gas turbine as claimed in claim 9, wherein the support structure is a portion of the combustion chamber wall.

* * * * *